US006712673B2

(12) United States Patent
Albrecht et al.

(10) Patent No.: US 6,712,673 B2
(45) Date of Patent: Mar. 30, 2004

(54) POLISHING APPARATUS, POLISHING HEAD AND METHOD

(75) Inventors: Peter Albrecht, O'Fallon, MO (US); Ashley Samuel Hull, St. Peters, MO (US); David Vadnais, St. Charles, MO (US)

(73) Assignee: MEMC Electronic Materials, Inc., St. Peters, MO (US)

( * ) Notice: Subject to any disclaimer, the term of this patent is extended or adjusted under 35 U.S.C. 154(b) by 150 days.

(21) Appl. No.: 09/682,677

(22) Filed: Oct. 4, 2001

(65) Prior Publication Data

US 2003/0068958 A1 Apr. 10, 2003

(51) Int. Cl.[7] ..... B24B 1/00; B24B 7/00

(52) U.S. Cl. ..... 451/41; 451/59; 451/63; 451/290; 451/388; 451/398; 451/288; 451/289

(58) Field of Search ..... 451/36, 41, 59, 451/63, 285, 287, 288, 289, 290, 388, 397, 398

(56) References Cited

U.S. PATENT DOCUMENTS

| | | | | |
|---|---|---|---|---|
| 3,849,948 A | * | 11/1974 | Youmans et al. | 451/29 |
| 5,377,451 A | | 1/1995 | Leoni et al. | |
| 5,423,716 A | | 6/1995 | Strasbaugh | |
| 5,449,316 A | | 9/1995 | Strasbaugh | |
| 5,605,487 A | | 2/1997 | Hileman et al. | |
| 5,635,083 A | * | 6/1997 | Breivogel et al. | 451/289 |
| 5,738,568 A | | 4/1998 | Jurjevic et al. | |
| 5,762,544 A | | 6/1998 | Zuniga et al. | |
| 5,791,978 A | | 8/1998 | Cesna et al. | |
| 5,899,798 A | | 5/1999 | Trojan et al. | |
| 5,916,015 A | | 6/1999 | Natalicio | |
| 5,941,758 A | * | 8/1999 | Mack | 451/41 |
| 5,957,751 A | | 9/1999 | Govzman et al. | |
| 5,961,169 A | | 10/1999 | Kalenian et al. | |
| 5,964,653 A | | 10/1999 | Perlov et al. | |
| 6,068,549 A | | 5/2000 | Jackson | |
| 6,146,259 A | | 11/2000 | Zuniga et al. | |
| 6,159,079 A | * | 12/2000 | Zuniga et al. | 451/41 |
| 6,162,116 A | | 12/2000 | Zuniga et al. | |
| 6,165,058 A | | 12/2000 | Zuniga et al. | |
| 6,183,354 B1 | | 2/2001 | Zuniga et al. | |
| 6,210,255 B1 | | 4/2001 | Zuniga et al. | |
| 6,210,260 B1 | | 4/2001 | Tanaka et al. | |
| 6,290,577 B1 | * | 9/2001 | Shendon et al. | 451/41 |

FOREIGN PATENT DOCUMENTS

| | | |
|---|---|---|
| EP | 0 362 811 | 4/1990 |
| EP | 0 934 801 | 8/1999 |
| EP | 1 049 145 | 11/2000 |

OTHER PUBLICATIONS

PCT International Search Report, 5 pages, Nov. 22, 2001.

* cited by examiner

*Primary Examiner*—Timothy V. Eley
(74) *Attorney, Agent, or Firm*—Senniger, Powers, Leavitt & Roedel

(57) ABSTRACT

A wafer polishing apparatus for polishing a semiconductor wafer. The polisher comprises a base, a turntable, a polishing pad and a head drive mechanism for driven rotation of a polishing head. The polishing head comprises a sealing ring adapted to hold at least one wafer for engaging a front surface of the wafer with a work surface of the polishing pad. The sealing ring allows for application of uniform air pressure over the rear surface of the wafer. The sealing ring is constructed so that the wafer itself defines a portion of a pressure cavity receiving pressurized air.

44 Claims, 5 Drawing Sheets

POLISHING APPARATUS, POLISHING HEAD AND METHOD

BACKGROUND OF THE INVENTION

This invention relates to apparatus for polishing semiconductor or similar type materials, and more specifically to such apparatus which facilitates equalization of the downward pressure over the polished wafer surface and the polishing head of the apparatus.

Polishing an article to produce a surface which is highly reflective and damage free has application in many fields. A particularly good finish is required when polishing an article such as a wafer of semiconductor material in preparation for printing circuits on the wafer by an electron beam-lithographic or photolithographic process (hereinafter "lithography"). Flatness of the wafer surface on which circuits are to be printed is critical to maintain resolution of the lines, which can be as thin as 0.13 microns (5.1 microinches) or less. The need for a flat wafer surface, and in particular local flatness in discrete areas on the surface, is heightened when stepper lithographic processing is employed.

Flatness is quantified in terms of a global flatness variation parameter (for example, total thickness variation ("TTV")) or in terms of a local site flatness variation parameter (e.g., Site Total Indicated Reading ("STIR") or Site Focal Plane Deviation ("SFPD")) as measured against a reference plane of the wafer (e.g., Site Best Fit Reference Plane). STIR is the sum of the maximum positive and negative deviations of the surface in a small area of the wafer from a reference plane, referred to as the "focal" plane. SFQR is a specific type of STIR measurement, as measured from the front side best fit reference plane. A more detailed discussion of the characterization of wafer flatness can be found in F. Shimura, Semiconductor Silicon Crystal Technology 191–195 (Academic Press 1989). Presently, flatness parameters of the polish surfaces of single side polished wafers are typically acceptable within a central portion of most wafers, but the flatness parameters become unacceptable near the edges of the wafers, as described below.

Polishing machines typically include an annular polishing pad mounted on a turntable for driven rotation about a vertical axis passing through the center of the pad. The wafers are fixedly mounted on pressure plates above the polishing pad and lowered into polishing engagement with the rotating polishing pad. A polishing slurry, typically including chemical polishing agents and abrasive particles, is applied to the pad for greater polishing interaction between the polishing pad and the wafer.

In order to achieve the degree of polishing needed, a substantial normal force presses the wafer into engagement with the pad. The coefficient of friction between the pad and wafer creates a significant lateral force on the wafer. This lateral force can give rise to certain distortions in the polish, such as by creating a vertical component of the frictional force at the leading edge of a wafer. The vertical component of the frictional force is created because the wafer is mounted to pivot about a gimbal point under influences of the lateral friction forces. A change in the net vertical force applied to the wafer locally changes the polishing pressure and the polishing rate of the wafer, giving rise to distortions in the polish. Often the uneven forces cause the wafer's peripheral edge margin to be slightly thinner than the majority of the wafer, rendering the edge margin of the wafer unusable for lithographic processing. This condition is a sub-species of the more general problems associated with wafer flatness, and will be referred to hereinafter as edge roll-off.

Improvements in wafer polishers have helped reduce edge roll-off. Recent configurations have incorporated conic bearing assemblies between the wafer and the mechanism applying the polishing force, while permitting free rotation of the wafer. Conic bearing assemblies are an improvement over traditional ball and socket configurations because the gimbal point of the mechanism is at a point below the bearing, nearer the interface between the wafer and the polishing pad. Wafers polished with a gimbal point near the work surface exhibit superior flatness characteristics, particularly near the outer edge of the wafer where conventional polishing processes exhibit characteristic "roll-off" and near the center of the wafer where slurry starvation may occur.

Another improvement directed toward more uniform wafer polishing is the use of a membrane to apply pressure to the rear surface of the wafer. Because membranes rely on air pressure to exert force upon the wafer, the pressure is thought to be more uniform over the wafer surface throughout the polishing process. Membranes, however, suffer from drawbacks. First, membranes must stretch during inflation to apply pressure over the wafer. Because the entire membrane must stretch as it attempts to engage the wafer, a portion of the pressure is used to stretch the wafer, instead of applying pressure to the wafer. Moreover, as the central portion of the membrane stretches toward the wafer, the lateral edges of the membrane are held tightly and cannot stretch enough to fully engage the wafer. By stretching the central portion only, while inhibiting the lateral edges of the membrane from engaging the wafer, the membrane provides inadequate support at the wafer's edge. Thus, the pressure applied at the edge of the wafer is due to the stiffness of the wafer itself, rather than from engagement with the membrane, causing the wafer edge to be underpolished. Secondly, if the rotational speed of the wafer and polishing pad become unsynchronized, torque is created on the wafer. Such torque can wrinkle the membrane, leading to uneven polishing or catastrophic failure, as the wafer may slip out of the polishing head during polishing. Thus, a configuration is needed incorporating further features for facilitating wafer flatness due to more uniform polishing, while overcoming the drawbacks mentioned above.

SUMMARY OF THE INVENTION

Among the several objects and features of the present invention may be noted the provision of a semiconductor wafer polishing apparatus, method and polishing head which apply uniform polishing pressure over the surface of the wafer; the provision of such an apparatus, method and head which facilitate better polishing pressure near the lateral edge of the wafer; and the provision of such an apparatus, method and head which provide efficient pick-up and release of the wafer from the polishing head.

Generally, a wafer polishing apparatus of the present invention for polishing a front surface of a wafer comprises a base for supporting elements of the polishing apparatus. A turntable mounts on the base for rotation about an axis on the base and is adapted to support a polishing pad for conjoint rotation with the turntable. The polishing pad has a work surface engageable with the front surface of the wafer for use in polishing the front surface of the wafer. A turntable drive mechanism operatively connects to the turntable for selectively driving rotation of the turntable about the axis of rotation. A polishing head mounts for holding the wafer in generally opposed relation with the turntable and for rotation about an axis generally parallel to the axis of rotation of the turntable. The polishing head includes a back plate having at least a central region in opposed relation with a rear surface of the wafer when the wafer is received by the polishing head. An annular sealing ring of flexible material has a thickness and is disposed around the central region of the back plate. The sealing ring has a central opening extending through the complete thickness of the sealing ring and is disposed for engaging a peripheral edge margin of the wafer, such that the rear surface of the wafer, the sealing ring and the back plate define a substantially fluid-tight cavity for controlling fluid pressure in the cavity.

In yet another embodiment of the present invention, a method of polishing a semiconductor wafer comprises placing a rear surface of the semiconductor wafer in engagement with a seal of the polishing head of a wafer polishing apparatus to form a fluid pressure cavity defined by the rear surface of the wafer, the seal and the polishing head. The wafer is mounted on the polishing head by evacuating the fluid pressure cavity to draw the wafer to the polishing head and hold the wafer. The method further comprises engaging a front surface of the wafer on the polishing head with a polishing pad on a turntable and urging the front surface of the wafer against the polishing pad by selectively applying air pressure within the cavity for pressing the wafer surface uniformly against the polishing pad. Air within the cavity directly engages a majority of the rear surface of the wafer. The wafer is disengaged from the turntable and removed from the polishing head.

The present invention is also directed to a polishing head generally set forth as above.

The present invention is also directed to a method of processing a semiconductor wafer. An oxide layer is formed on a rear surface of the semiconductor wafer. The semiconductor wafer is then free-mounted on a polishing head of a wafer polishing apparatus. A front surface of the wafer on the polishing head engages a polishing pad on a turntable. Relative motion between the wafer and the polishing pad is obtained, and the front surface of the wafer is urged against the work surface. The wafer is removed from the polishing head.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
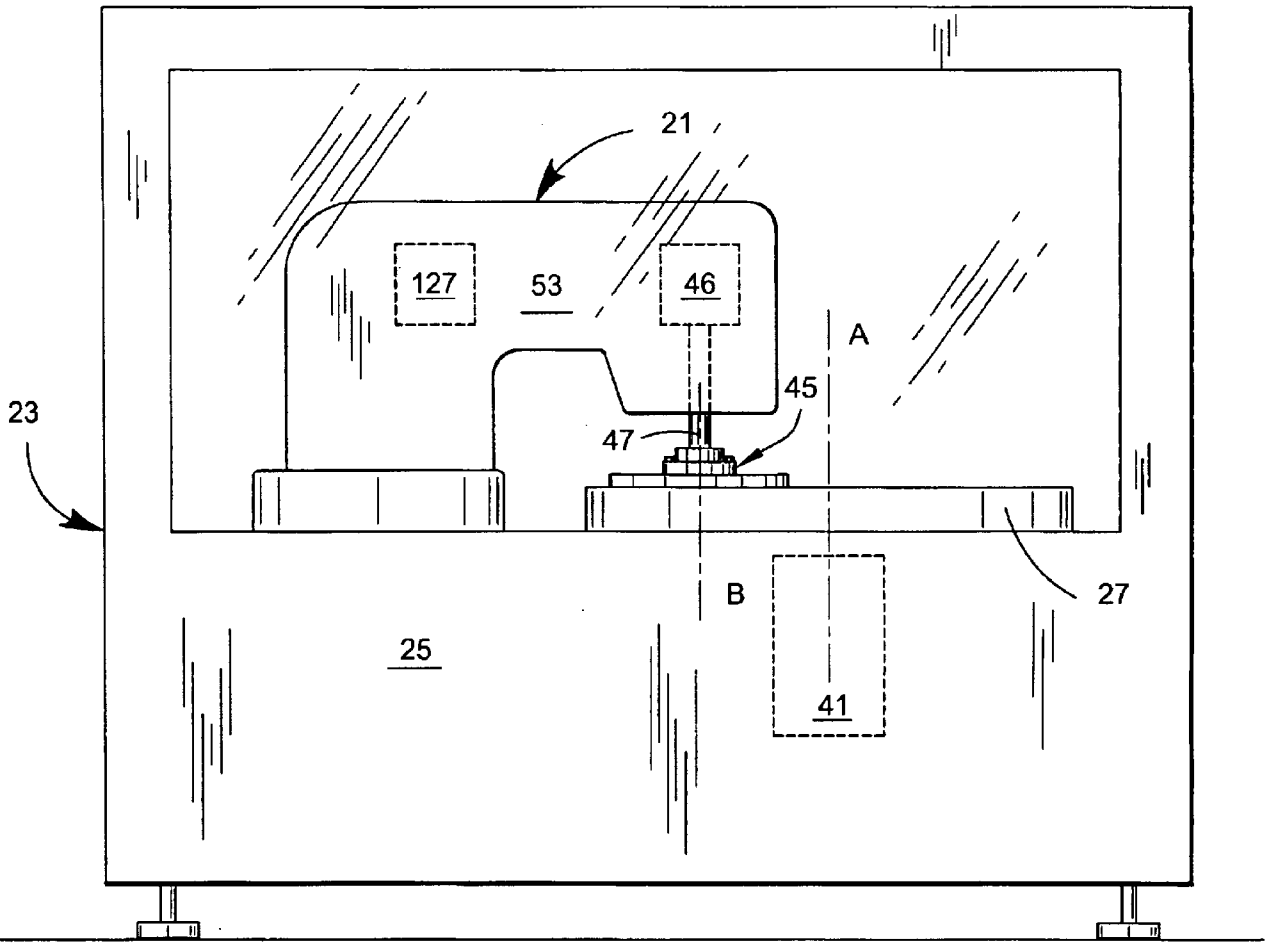
FIG. 1 is a schematic side elevation of the wafer polishing apparatus inside a non-contamination booth.
Figure 2:
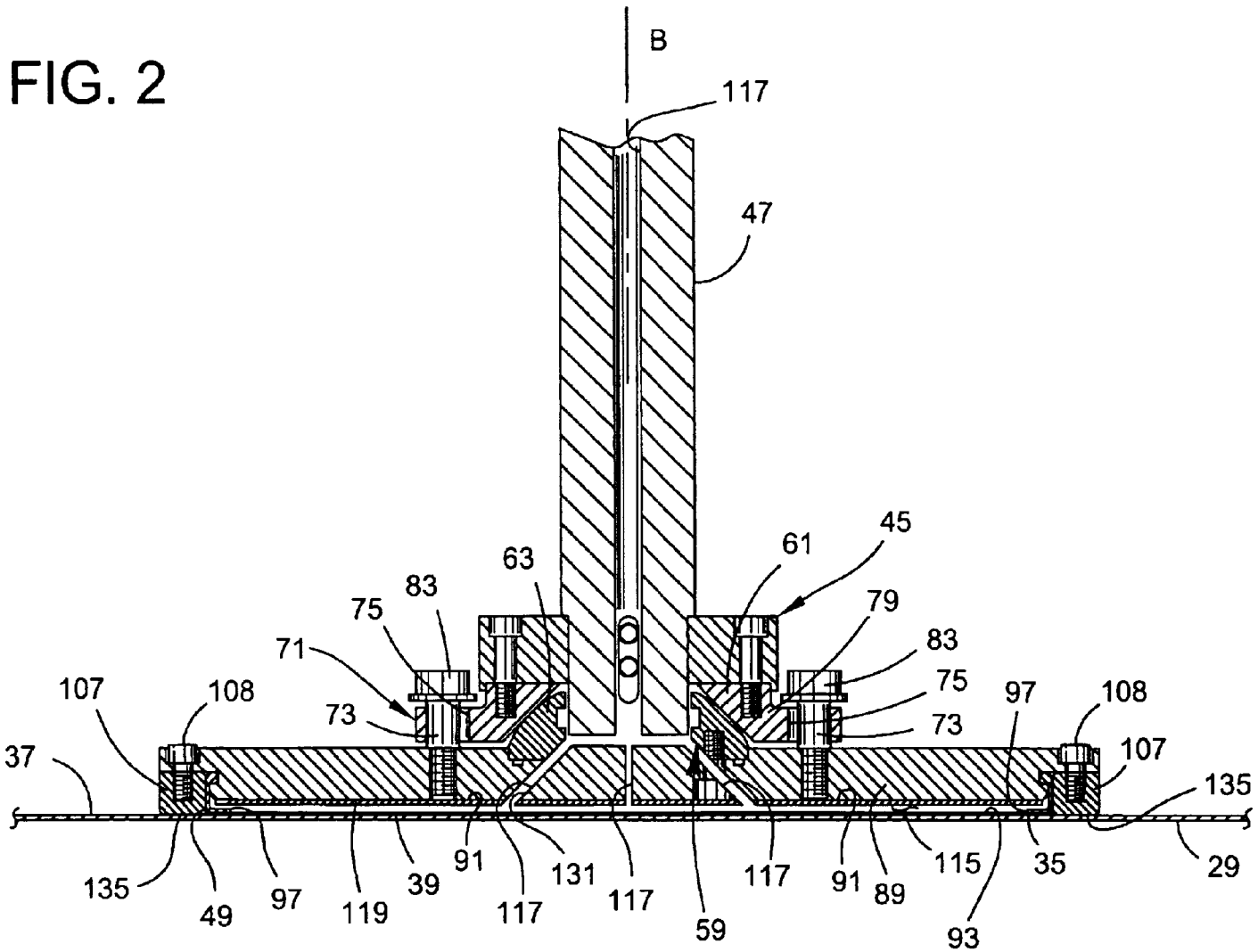
FIG. 2 is a section of the polishing head of the present invention.

Referring now to the figures, specifically to FIGS. 1 and 2, a wafer polishing apparatus, generally indicated at 21, constructed according to the present invention is shown having a base, generally indicated at 23, for housing and supporting other elements of the polishing apparatus. The base 23 may be of various configurations, but preferably is formed to provide a stable support for the polishing apparatus 21. In the preferred embodiment, the base 23 comprises a booth 25 enclosing the wafer polishing apparatus 21 and inhibiting airborne contaminants from entering the booth and contaminating the apparatus and articles to be polished. Except as pointed out hereinafter with regard to the way a semiconductor wafer 35 is held and polished by the polishing apparatus 21 during polishing, the construction of the polishing apparatus is conventional. An example of such a conventional single-sided polishing apparatus 21 of the type discussed herein is the Strasbaugh Model 6DZ, available from Strasbaugh Inc. of San Luis Obispo, Calif.

A turntable 27 is mounted on the base 23 for rotation with respect to the base, as shown in FIG. 1. The turntable 27 is circular and is adapted to support a polishing pad 29 thereon for polishing a front surface 39 of the semiconductor wafer 35 (FIG. 2). The polishing pad 29 is preferably adhesive-backed for securing the pad to the turntable 27. The turntable and polishing pad 29 rotate conjointly relative to the base 23 about an axis A perpendicular to the turntable and polishing pad. The opposite side of the polishing pad 29 comprises a work surface 37 engageable with the front surface 39 of the semiconductor wafer 35 for use in polishing the front surface. Polishing pads are preferably formed from a urethane foam material, for example, RodelÂ® URI100 and SPM3100 pads (available from Rodel, Inc. of Phoenix, Ariz.) or FujimiÂ® SCCB (available from Fujimi Corporation of Elmhurst, Ill.). Other suitable materials are also contemplated as within the scope of the present invention. During polishing, the polishing pad 29 is configured to receive a continuous supply of polishing slurry. The polishing slurry is delivered to the pad 29 via a slurry delivery system (not shown). Polishing pads 29, polishing slurry, and slurry delivery systems are well known in the relevant art.

Continuing with FIG. 1, the base 23, booth 25, turntable 27, and a turntable drive mechanism 41 are each well known in the art and comprise the basic elements of the single-side wafer polishing apparatus 21 noted above. The turntable drive mechanism 41 operatively connects to the turntable 27 for selectively driving rotation of the turntable about axis A. The subject of the present invention is a new and useful addition to such a polishing apparatus 21, as discussed in greater detail below.

The wafer polishing apparatus 21 further comprises a polishing head, generally indicated at 45 (FIGS. 1 and 2), pivotably and rotatably connectable to a head drive mechanism 46. The head drive mechanism is operatively connected to the polishing head 45 for driving rotation of the polishing head about an axis B (FIGS. 1 and 2). The primary purpose of the polishing head 45 is holding the wafer 35 securely during polishing so that the wafer may be polished evenly. The polishing head 45 mounts on the lower end of an output shaft 47 so that they rotate conjointly. Polishing heads 45 are conventionally used to perform single-side polishing, but suffer various drawbacks relating to the quality of the polished wafer 35. The polishing head 45 of the present embodiment avoids those drawbacks by further comprising a sealing ring 49, as discussed in greater detail below.

A polisher arm 53 applies downward pressure to the polishing head 45 during wafer polishing (FIG. 1). A hydraulic or pneumatic actuation system is commonly used to articulate the arm 53, although other articulation systems are contemplated as within the scope of the present invention. These systems are well known in the relevant art and will not be described in detail here. Downward force from the actuation system is transferred to the wafer 35 through the output shaft 47 and polishing head 45.

The axis of rotation of the polishing head (axis B) is spaced apart from an axis of rotation (axis A) of the turntable (FIG. 1). This spacing helps ensure that the wafer 35 is subject to even polishing over a substantial portion of the polishing pad 29. The polishing pad is preferably much wider than the wafer 35 and polishing head 45, so that no portion of the wafer passes over the central portion of the polishing pad during polishing. This helps increase the longevity of the polishing pad 29 and the evenness of the wafer polish, because the wafer 35 interacts with a majority of the polishing pad.

Additionally, the polishing head 45 and the turntable 27 rotate at different relative rotational speeds for more uniform and efficient polishing of the wafer 35. Regulating the rotational speed of the polishing head 45 impacts the wear pattern of the polishing pad 29, which in turn impacts wafer 35 flatness and polishing pad life. The rotation of the wafer 35 and the polishing pad 29 can be modeled mathematically to compare the relative velocities of each for determining what relative velocities will likely provide the most even polishing and longest pad life. The polishing head 45 is preferably driven at a rotational speed less that the turntable 27. Were the wafer 35 and polishing head 45 allowed to freely rotate, they would rotate at approximately the same speed as the polishing pad 29, leading to uneven wear of the pad. Thus, the head drive mechanism 46 actually throttles the rotational speed of the polishing head 45 so that the polishing head rotates at a rotational speed of between about fifty percent (50%) and about one hundred percent (100%) of the rotational speed of the turntable 27. More particularly, the best polishing is achieved where the head drive mechanism 46 rotates at a rotational speed of between about ninety percent (90%) and about one hundred percent (100%) of the rotational speed of the turntable 27. Operating the head drive mechanism 46 and turntable 27 at similar rotational speeds reduces torque on the polishing head 45 and wafer 35.

Turning to the construction of the apparatus 21, the polishing head 45 mounts on the head drive mechanism 46 for driven rotation of the polishing head (FIGS. 1 and 2). The polishing head 45 is adapted to hold the wafer 35 in generally opposed relation with the turntable 27, for engaging the front surface 39 of the wafer with the work surface 37 of the polishing pad 29. The polishing head 45 is further attachable to the head drive mechanism 46 via a spherical bearing assembly, generally indicated at 59, for pivoting of the polishing head about a gimbal point lying near the work surface 37. The polishing head 45 holds the front surface 39 of the wafer 35 in engagement with the polishing pad 29, for polishing the wafer and allowing the plane of the front surface of the wafer to continuously align itself to equalize polishing pressure over the front surface of the wafer for more uniform polishing of the wafer. The gimbal point preferably lies no higher than the interface of the front surface 39 of the wafer 35 and the work surface 37 when the polishing head 45 holds the wafer in engagement with the polishing pad 29. The head drive mechanism 46 drives rotation of the polishing head 45 for maintaining the front surface 39 and work surface 37 in flatwise engagement for more uniform polishing of the wafer 35.

The spherical bearing assembly 59 further comprises an upper conical seat 61 attachable to and rotating with the head drive mechanism 46 (FIG. 2). A lower spherical pivot 63 rigidly mounts on the polishing head 45 and extends upward toward the head drive mechanism 46. The lower spherical pivot 63 is engageable with the upper conical seat 61 for pivotable movement of the polishing head 45 with respect to the head drive mechanism 46. The lower spherical pivot 63 has an upwardly directed spherical face 65. Any line normal to the spherical face 65 passes through the gimbal point. The pivoting motion aids in creating uniform pressure over a retaining ring 107 of the polishing head 45 (discussed in greater detail below), enhancing the ability of the retaining ring to retain the wafer 35. The gimbal point lies at or slightly below an interface of the wafer 35 and the work surface 37 on a side of the interface containing the turntable 27. This geometry maintains the work surface 37 and the polishing head 45 in flatwise engagement. This configuration further inhibits low pressure points from forming near the trailing edge of the polishing head 45 due to pivoting of the polishing head relative to the turntable 27 and helps retain the wafer. Preferably, the lower spherical pivot 63 is formed from a high strength metal, such as stainless steel, and the upper conical seat 61 is formed from a plastic material, such as PEEK, a polyaryletherketone resin, available from Victrex USA Inc. of Westcheter, Pa., U.S.A. Both surfaces are highly polished to inhibit wear debris generation and to minimize friction within the spherical bearing assembly 59 and create a highly smooth pivoting movement of the bearing assembly.

A semi-rigid connection, generally indicated at 71, is attachable to the output shaft 47 and the polishing head 45 for transferring a rotational force from the head drive mechanism 46 to the polishing head, while permitting universal pivoting motion of the polishing head with respect to the head drive mechanism about the spherical bearing assembly 59. The semi-rigid connection 71 comprises a plurality of shoulder bolts 73 attachable to the polishing head 45 (FIG. 2). These shoulder bolts 73 extend upward from the polishing head 45 and pass through a series of radial slots 75 in an annular flange 79 extending laterally from the upper conical seat 61. The radial slots 75 are sized slightly larger than the shoulder bolts 73 so that as the output shaft 47 rotates, the radial slots engage the bolts for inducing rotation of the polishing head 45. The additional clearance between the radial slots 75 and the bolts 73 allows the upper conical seat 61 and the lower spherical pivot 63 to pivot slightly with respect to one another. The pivoting allows for more uniform retaining ring pressure and continuous transmission of rotation from the head drive mechanism 46 to the polishing head 45. The flange 79 and upper conical seat 61 are of unitary, plastic construction. When the head drive mechanism 46 is lifted upward after polishing, a bolt head 83 of each shoulder bolt 73 engages the plastic flange 79, such that the polishing head 45 is lifted from the work surface 37.

Figure 3:
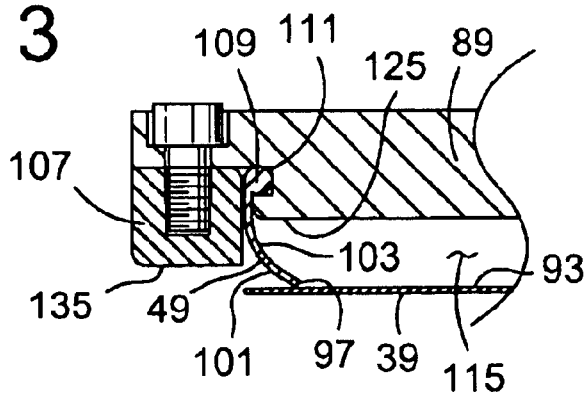
FIG. 3 is an enlarged, fragmentary portion of the polishing head section of FIG. 2 but lacking a support pad and with a sealing ring in position to pick up a wafer.

Turning to the novel features of the present invention, the polishing head 45 includes a back plate 89 having at least a central region 91 in opposed relation with a rear surface 93 of the wafer 35 when the wafer engages the polishing head. The back plate 89 is preferably a one-piece, rigid part. The annular sealing ring 49 is mounted on the underside of the polishing head 45 (FIGS. 2 and 3). The sealing ring 49 is preferably formed from flexible material having a thickness. The flexible material of the sealing ring 49 is preferably thin and adapted to flex upon receiving the wafer 35 on the polishing head. The sealing ring 49 may comprise an elastomeric material selected from a group including rubber, silicone and urethane. In the preferred embodiment, the sealing ring 49 is formed from 40 durometer EDPM (Ethylene Propylene Diene Monomer). The sealing ring is preferably about 0.79 millimeter (0.031 inch) thick. Other materials are contemplated as within the scope of the present invention. For example, non-contamination materials exhibiting a flexibility adequate to conform to the wafer 35 and a resiliency sufficient to transfer the rotational motion of the polishing head 45 to the wafer may be substituted for the preferred material.

The sealing ring 49 is disposed around the central region 91 of the back plate 89 and has a central opening 97 extending through the complete thickness of the sealing ring. The sealing ring is disposed for engaging a peripheral edge margin of the wafer 35. The sealing ring 49 has a first major surface opposite a second major surface, hereinafter referred to as an outer surface 101 and an inner surface 103, respectively. At least a portion of the outer surface 101 is engageable with the wafer 35 for mounting and sealing the wafer on the polishing head 45, whereas the inner surface 103, opposite the outer surface, faces the polishing head.

Figure 4:
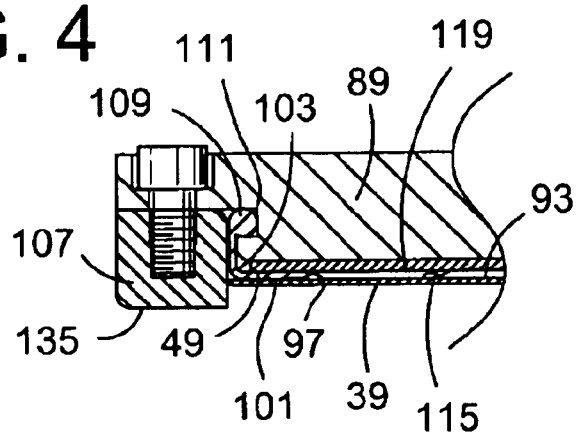
FIG. 4 is an enlarged, fragmentary portion of the polishing head section of FIG. 2 with the wafer held by vacuum against a support pad.

Referring now to FIGS. 2 and 3, the polishing head 45 further comprises the retaining ring 107 that encircles the sealing ring 49 and is mounted on the polishing head by a series of angularly spaced bolts 108 (only two are shown in FIG. 2). A primary function of the retaining ring 107 is to retain the wafer 35 in the polishing head 45 during polishing by forming a barrier against lateral motion of the wafer out from under the polishing head. Thus, the retaining ring 107 extends below the back plate 89 to be in radially opposed relation with a peripheral edge of the wafer (FIG. 4).

The sealing ring 49 includes an annular bead 109 received within a groove 111 of the back plate 89 for mounting the sealing ring on the polishing head 45. The retaining ring 107 closes the groove 111 and clamps the sealing ring 49 against the back plate 89. The portion of the sealing ring 49 not clamped between the retaining ring 107 and the back plate 89 is free to flex inward and outward from the back plate 89 a short distance. As the retaining ring 107 wears in normal use, it becomes thinner. The ability of the free portion of the sealing ring 49 to freely flex relative to the retaining ring 107 assures that the sealing ring will not force the wafer 35 below the bottom edge of the retaining ring.

A substantially fluid-tight cavity 115 is defined by the rear surface 93 of the wafer 35, the sealing ring 49 and the back plate 89 for controlling fluid pressure in the cavity. A source of vacuum, as discussed below, communicates with the polishing head 45 via a series of channels 117 in the output shaft 47 and head (FIG. 2). The sealing ring 49 extends outwardly from the retaining ring 107 when the wafer 35 is not received in the polishing head 45 (FIG. 3). The sealing ring 49 also extends radially inwardly toward axis B of the polishing head 45 when the wafer 35 is not received in the polishing head, presenting the outer surface 101 for engagement with the rear surface 93 of the wafer.

Because the sealing ring 49 extends downwardly and inwardly, the central opening 97 of the sealing ring presents a circular edge for initial engagement with the rear surface 93 of the wafer 35 when the wafer is brought into close proximity with the polishing head 45 (FIG. 3). The central opening 97 forms a circular seal with the wafer 35, so that when a vacuum is drawn in the cavity 115, the wafer is drawn up into the polishing head 45. In other words, the greater air pressure outside the cavity 115, as compared with inside the cavity, lifts the wafer 35 upward toward the polishing head 45 as a vacuum is drawn within the cavity. The free edge portion of the sealing ring 49 is clamped between the wafer 35 and the back plate 89 (FIG. 4). The wafer 35 is drawn toward engagement with the back plate 89 so that the polishing head 45 may pick up the wafer. A support pad 119 may also mount on the underside of the back plate 89 for supporting the wafer 35 when held by the polishing head 45. The support pad 119 is preferably formed from a resilient material less rigid than the back plate 89 for resiliently engaging the wafer 35 when mounting the wafer on the polishing head 45. For instance, the support pad 119 may be readily formed from used polishing pad material, as described above. Such material is soft enough to resiliently engage the wafer 35 when engaging the polishing head 45 (FIG. 4). Moreover, the support pad 119 is preferably non-smooth to reduce the contact area of the support pad engageable with the sealing ring 49, thereby reducing the adhesive forces and allowing the support pad to release the sealing ring.

Alternately, where a portion 125 of the back plate 89 is exposed for engagement with the inner surface 103 of the sealing ring 49 (e.g., FIG. 3), such portion may be cross-hatched, textured or otherwise non-smooth. This reduces the contact area of the portion 125 engageable with the sealing ring 49 to reduce the adhesive forces between the sealing ring and back plate 89, thereby allowing the back plate to release the sealing ring. The support pad 119 also serves this purpose by preventing the sealing ring 49 from adhering to the back plate 89.

A fluid pressure control 127, such as a source of vacuum (FIG. 1), is adapted to affect fluid pressure within the cavity 115. The pressure control 127 selectively applies vacuum pressure to the cavity 115 for capturing the wafer 35 on the polishing head 45. At least one orifice 131 in the back plate 89 affects fluid communication of the cavity 115 with the pressure control 127 via the channels 117.

Figure 5:
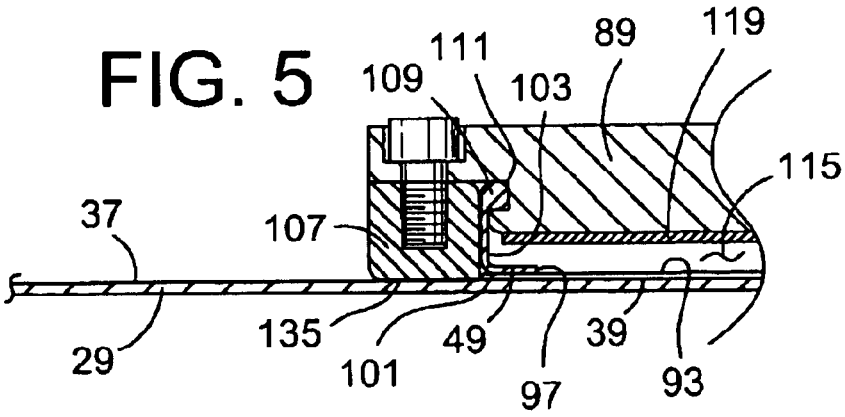
FIG. 5 is an enlarged, fragmentary portion of the polishing head section of FIG. 2 shown polishing the wafer.

Beyond applying vacuum pressure to pick up the wafer 35 (FIGS. 3 and 4), the pressure control 127 is also adapted to selectively apply positive air pressure within the cavity 115 for urging the wafer 35 toward the polishing pad 29 to polish the front surface 39 of the wafer, as shown in FIG. 5. The pressure control 127 increases the air pressure within the cavity 115 until the wafer 35 engages the polishing pad 29 with sufficient force to polish the wafer. The sealing ring 49 flexes outward to engage the retaining ring 107 and wafer 35, to maintain a fluid tight seal of the cavity 115. The use of fluid pressure in combination with the flexible sealing ring 49 allows the pressure to equalize over the back surface 93 of the wafer 35 throughout polishing. The operation of the polishing head 45 will be discussed in greater detail below.

The size of the central opening 97 is also important for adjusting the polishing attributes of the apparatus 21. Preferably, the inner diameter of the central opening 97 as measured when not engaging the wafer 35 (or when just engaging the wafer, as shown in FIG. 3) is between about 50% and about 95% of the wafer diameter. For a wafer 35 with a diameter of 200 millimeters (7.9 inches), the central opening 97 is preferably between about 100 millimeters (3.9 inches) and about 190 millimeters (7.5 inches). More specifically, the inner diameter is between about 80% and about 90% of the wafer 35 diameter. For a wafer 35 with a diameter of 200 millimeters (7.9 inches), the central opening 97 is preferably between about 160 millimeters (6.3 inches) and 180 millimeters (7.1 inches) in diameter. When the central opening 97 is about 85% of the wafer 35 diameter, the polisher polishes optimally. For a wafer 200 millimeters in diameter, this corresponds to a central opening 97 of 170 millimeters (6.7 inches). For a wafer 300 millimeters in diameter, the optimal diameter central opening 97 increases to 255 millimeters (10 inches). These preferred central opening 97 sizes are based upon the preferred sealing ring 49 material disclosed above, and those preferred sizes may change with a different sealing ring material.

Figure 6:
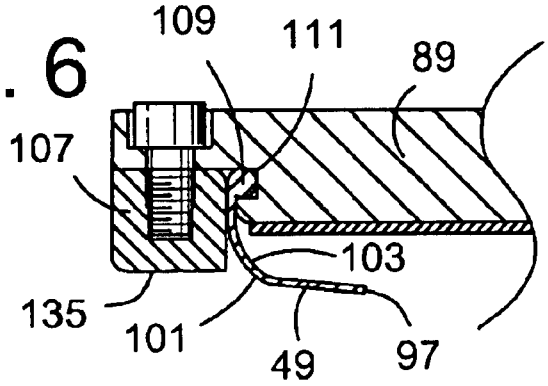
FIG. 6 is an enlarged, fragmentary section of the polishing head of the present invention having a sealing ring having a smaller central opening.
Figure 7:
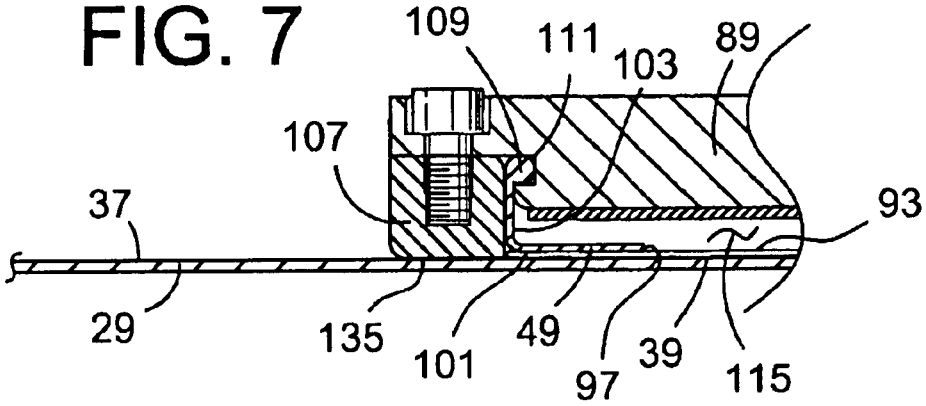
FIG. 7 is the enlarged, fragmentary section of FIG. 6 shown polishing a wafer.

During polishing, the sealing ring 49 may stretch slightly due to the application of pressure, slightly increasing the size of the central opening 97 from its nominal size. Changes in the durometer of the material selected for the sealing ring 49 may also drive alteration of the appropriate size of the central opening 97. Where the sealing ring 49 is formed from a more flexible material, it will flex more during use and the central opening 97 need not be as large to ensure an adequate stretch of the sealing ring for proper contact with the wafer 35 (FIGS. 6 and 7). An opening 97 smaller than the examples noted above is not desirable, however, because it creates additional, unnecessary engagement area between the wafer and the sealing ring 49. Less engagement of the wafer 35 and sealing ring 49 (i.e., a larger opening 97) is more desirable because more wafer area is subject to the direct engagement of uniform air pressure within the cavity 115 and wafer contamination is lessened due to any contaminants present on the sealing ring.

Conversely, a sealing ring 49 formed from a more inelastic material may require a larger opening 97 because the material is less flexible and is less likely to stretch to conform with the wafer 35 without a larger opening. An example of such an inelastic material is a fluorocarbon rubber, such as VitonÂ®, available from E. I. Dupont de Nemours Company of Wilmington, Del. A larger opening 97, such as those in the preferred ranges noted above, provides more area over the rear surface 93 of the wafer for uniform pressure application. Moreover, a larger opening 97 may allow the sealing ring 49 to further conform to the retaining ring 107 and wafer 35, encouraging more uniform application of pressure on the peripheral edge of the wafer 35. Too large of an opening 97, however, may implicate another problem, sealing ring 49 blowout. As the pressure within the cavity 115 increases, such as during polishing, the sealing ring 49 must have the strength to remain inwardly directed, so that the cavity 115 remains intact. Where the opening 97 is too large, the pressure may cause the sealing ring 49 to slide off the wafer 35, causing it to blowout and release the wafer 35. Furthermore, too large an opening 97 reduces the contact area with the wafer 35, thus reducing the frictional force holding the wafer. Because torque must be applied to the wafer 35, such a reduction in friction may lead to wafer slippage and backside polishing.

The present invention is ideally suited for polishing a wafer 35 previously polished on a double-side polished wafer polisher. Such a wafer 35 is already polished substantially flat, so that any additional polishing is aimed at removing a uniform layer of silicon material over the entirety of the wafer, without generally impacting wafer flatness. The sealing ring 49 configuration of the present invention is particularly well suited for such a purpose. As the retaining ring 107 is pressed firmly against the polishing pad 29 for retaining the wafer 35, the sealing ring 49 and uniform air pressure across the rear surface 93 of the wafer allows the wafer to conform to the polishing pad for removal of a uniform layer of silicon. Moreover, the flexibility of the sealing ring 49 allows it to conform to the rear surface 93 of the wafer 35, particularly the peripheral edge of the rear surface. By conforming more closely to the peripheral edge of the wafer 35, the pressure within the polishing head 45 is exerted more uniformly upon the entire rear surface 93 of the wafer, including the lateral edges. Such uniform polishing pressure has advantages over a polisher using a rigid surface to support a wafer 35 during polishing. First, the polishing head 45 retains the wafer 35 without an adhesive, thereby reducing complexity and eliminating a possible contaminant. The polishing head 45 initially secures the wafer 35 with a vacuum, eliminating one source of potential contamination. Second, because the polishing pressure is applied to the wafer 35 directly by a fluid and only at the wafer periphery by the sealing ring 49, there is less concern of contamination. Any particulate matter on the rear surface 93 of the wafer 35 coincident with the central opening 97 is not likely to impact polishing, as it may with rigid wafer support structures, because the air in the cavity 115 applies pressure directly to the rear surface, irrespective of the contaminants. Moreover, any particulate matter inadvertently caught between the wafer 35 and the sealing ring 169 is less likely to affect the polished surface. With conventional rigid support systems, particulate matter can become lodged between the wafer 35 and the rigid support structure, creating dimples in the polished surface. The foregoing benefits are also realized by the current configuration over conventional thin backing film configurations, which apply mechanical pressure to the wafer by a soft pad. Any method that applies mechanical pressure to the wafer is prone to generate uneven polishing and material removal. Primary reasons include uneven mechanical pressure because of local stiffness variations in the soft backing pad and uneven flatness of the surface to which the pad is mounted. In contrast, air pressure applied directly to the wafer inherently results in uniform polishing pressure.

During polishing, particulate matter puts pressure on the rear surface of the wafer, thereby pushing a small portion of the wafer outward toward the polishing pad. The polishing operation seeks to flatten the wafer, and typically flattens this small portion of the wafer pushed outward by the foreign matter. Once the wafer is removed from the rigid support, the portion of the wafer pushed out by the particulate matter returns to its original position, leaving a dimple defect in the polished surface. With a sealing ring 49, any particulate matter lodged between the sealing ring and the wafer 35 will temporarily deform the sealing ring, not the wafer 35, allowing the wafer to be polished without dimpling. Moreover, any particulate matter on the rear surface 93 of the wafer is less likely to affect the polish because the air imparts polishing pressure directly upon the wafer 35.

Additionally, the sealing ring 49 betters conventional polisher configurations, specifically membrane configurations, because it eliminates superfluous membrane material that adds no additional polishing benefits. The sealing ring 49 is large enough to transmit torque and create a seal for the cavity 115 without any material engaging the center of the wafer 35. Moreover, the sealing ring 49 provides the advantage of quickly and efficiently picking up and releasing the wafer 35. The central opening 97 of the sealing ring 49 readily engages the back surface 93 of the wafer 35 to create a seal, while the majority of the back surface is free from engagement with the sealing ring. This allows the vacuum created within the cavity 115 to quickly pull the wafer 35 into engagement with the polishing head. During release, the wafer 35 more quickly disengages from the polishing head 45 because a large portion of the back surface 93 of the wafer receives the full force of the air pressure returning to the cavity 115. Membrane configurations require a much greater contact area between the wafer and the polishing head, thereby increasing the adhesive forces between the two. These adhesive forces impede the ability of the polishing head to release the wafer after polishing. Moreover, membrane configurations are generally complicated mechanically, as compared with the present configuration.

Finally, unlike membrane configurations, as the sealing ring 49 stretches during use, the additional material is less likely to wrinkle and cause uneven polishing pressure on the wafer 35. Any additional material engaging the wafer merely creates a potential for wrinkling as the membrane stretches, which may ultimately lead to uneven polishing and inadequate frictional force between the wafer and membrane.

Figure 8:
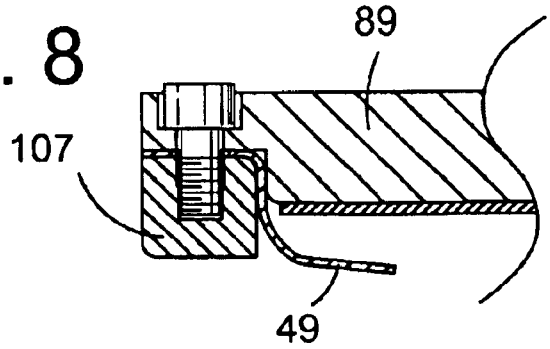
FIG. 8 is an enlarged, fragmentary section of a polishing head of a second embodiment.
Figure 9:
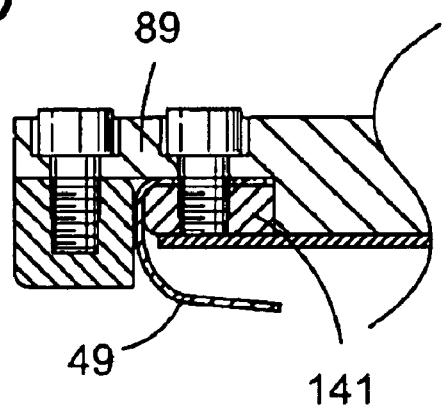
FIG. 9 is an enlarged, fragmentary section of a third embodiment.

In a second embodiment of the present invention, the sealing ring 49 mounts on the polishing head 45 in a novel way. As shown in FIG. 8, the outer edge of the sealing ring 49 no longer includes a bead, as with the previous embodiment, but is clamped between the retaining ring 107 and the back plate 89. In all other respects, the apparatus 21 is identical to the first embodiment. Similarly, FIG. 9 depicts a sealing ring 49 configuration of a third embodiment. Here, the polishing head 45 includes an annular hoop 141 that clamps the sealing ring 49 between itself and the back plate 89. In all other respects, the apparatus 21 is identical to the first embodiment.

The present invention further comprises a method of polishing a semiconductor wafer 35. The method comprises multiple steps, which may be carried out with the apparatus 21 described above. The rear surface 93 of the wafer 35 is placed in engagement with the sealing ring 49 of the polishing head 45 of the wafer polishing apparatus 21, forming the fluid pressure cavity 115, defined by the rear surface 93 of the wafer, the seal and the polishing head. The seal of the polishing head 45 is preferably the sealing ring 49 as set forth above. Relative motion between the wafer and the polishing pad is then obtained, as described in detail above. Selectively applying air pressure within the cavity 115 urges the front surface 39 of the wafer 35 against the work surface 37 for pressing the wafer surface uniformly against the polishing pad 29. Air within the cavity 115 directly engages a majority of the rear surface 93 of the wafer 35, creating more uniform pressure application of the wafer. Moreover, because the sealing ring 49 conforms more closely to the lateral edges of the rear surface 93 of the wafer 35, polishing pressure at the lateral edge of the wafer is increased to levels adequate to more evenly polish the edge of the wafer. As discussed previously, the sealing ring 49 of the present method provides substantial benefits over traditional configurations incorporating rigid backing plates or membranes. Finally, the wafer 35 is held on the polishing head 45 by re-applying a vacuum and then removed from the polishing head 45 by applying positive pressure.

Another embodiment of the present invention comprises a polishing method generally as set forth above with an additional processing step of forming an oxide layer on a rear surface 93 of the semiconductor wafer 35. Because the wafer 35 is free-mounted on the polishing head (i.e., without the use of a wax layer), the rear side 93 of the wafer of the present invention is susceptible to damage and must be protected during processing. During polishing, some polishing slurry may inadvertently squeeze between the sealing ring 49 and the wafer 35. Such slurry can stain the rear surface 93 of the wafer 35 or increase backpolishing and scratching of the rear surface, both of which are undesirable. Moreover, even small amounts of sliding between the sealing ring 49 and the rear surface 93 of the wafer 35 may create microscopic scratches. Such sliding may occur from torque, as described above, or from very slight movement of the sealing ring 49 as pressure is applied. The additional processing step of forming an oxide layer on the rear surface 93 of the wafer 35 protects the rear surface from staining, backpolishing and scratches due to processing.

Figure 10:
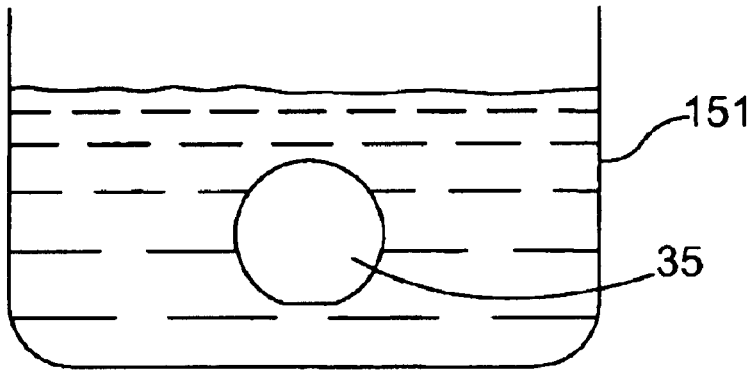
FIG. 10 is a schematic side elevation of the wafer in a bath.

An oxide layer may be formed on a wafer 35 in a number of different ways. As shown in FIG. 10, the wafer 35 may be placed in a bath 151 to form an oxide layer. Such a bath 151 preferably comprises an aqueous solution of approximately 0.5 molar hydrogen peroxide and 0.03 molar ammonia for soaking a wafer 35 for at least four minutes. Alternately, a weaker solution and a longer time will yield a similar oxide layer and similar beneficial results. During polishing, such an oxide layer will protect the polysilicon underneath the oxide layer from harm. Because the entire wafer 35 is placed within the bath 151, an oxide layer will also form on the front surface 39 of the wafer. Polishing such a front surface 39 after immersion in the bath 151 will readily remove the oxide layer from the front surface. Other methods of forming an oxide layer on a wafer 35, such as an aqueous solution of oxide bath, are also contemplated as within the scope of the present invention.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A wafer polishing apparatus for polishing a front surface of a wafer, the polishing apparatus comprising:

a base for supporting elements of the polishing apparatus;

a turntable mounted on the base for rotation about an axis on the base and adapted to support a polishing pad for conjoint rotation with the turntable, the polishing pad having a work surface engageable with the front surface of the wafer for use in polishing the front surface of the wafer;

a turntable drive mechanism operatively connected to the turntable for selectively driving rotation of the turntable about the axis of rotation; and a polishing head mounted for holding the wafer in generally opposed relation with the turntable and for rotation about an axis generally parallel to the axis of rotation of the turntable, the polishing head including a back plate having at least a central region in opposed relation with a rear surface of the wafer when the wafer is received by the polishing head, and an annular sealing ring of flexible material having a first surface and second surface opposite said first surface defining a thickness and disposed around the central region of the back plate, the sealing ring having a central opening extending through the complete thickness of the sealing ring, the sealing ring being adapted to flex and conform to the rear surface of the wafer upon receiving the wafer on the polishing head such that a portion of the first surface conforms to a peripheral edge margin of the wafer and a portion of said second surface faces the back plate, wherein the central opening as measured when not engaging the wafer is less than 90% of the wafer diameter so that the first surface conforms to more than 10% of the wafer diameter at the outer peripheral edge margin of the wafer to frictionally engage the wafer, and wherein the rear surface of the wafer, the sealing ring and the back plate define a substantially fluid-tight cavity for controlling fluid pressure in the cavity.

2. Wafer polishing apparatus as set forth in claim 1 wherein the sealing ring has an inner diameter of the central opening as measured when not engaging the wafer which is greater than or equal to about 50% of the wafer diameter.

3. Wafer polishing apparatus as set forth in claim 2 wherein the sealing ring has an inner diameter of the central opening as measured when not engaging the wafer which is greater than or equal to about 80% of the wafer diameter.

4. Wafer polishing apparatus as set forth in claim 3 wherein the sealing ring has an inner diameter of the central opening as measured when not engaging the wafer which is preferably about 85% of the wafer diameter.

5. Wafer polishing apparatus as set forth in claim 1 wherein the polishing head further comprises a retaining ring mounted on the polishing head, the sealing ring being clamped between the retaining ring and the back plate.

6. Wafer polishing apparatus as set forth in claim 5 wherein the retaining ring extends outwardly from the back plate for use in retaining the wafer in the polishing head.

7. Wafer polishing apparatus as set forth in claim 6 wherein the sealing ring has a bead and the back plate has a groove receiving the bead for mounting the sealing ring on the polishing head.

8. Wafer polishing apparatus as set forth in claim 5 wherein the sealing ring extends outwardly from the retaining ring when the wafer is not received in the polishing head.

9. Wafer polishing apparatus as set forth in claim 8 wherein the sealing ring extends radially inwardly toward the axis of rotation of the polishing head when the wafer is not received in the polishing head to present said first major surface of the sealing ring for engagement with the rear surface of the wafer.

10. Wafer polishing apparatus as set forth in claim 5 wherein the polishing head further comprises a support pad mounted on the back plate, the support pad being made of a material less rigid than the back plate for resiliently engaging the wafer when mounting the wafer on the polishing head.

11. Wafer polishing apparatus as set forth in claim 10 wherein the support pad is non-smooth to reduce the contact area of the support pad engageable with the sealing ring to reduce the adhesive forces for allowing the support pad to release the sealing ring.

12. Wafer polishing apparatus as set forth in claim 5 wherein the sealing ring is movable independently of the retaining ring so that as the retaining ring wears, an offset between the bottom of the retaining ring and the sealing ring may be maintained.

13. Wafer polishing apparatus as set forth in claim 5 further comprising a head drive mechanism operatively connected to the polishing head for driving rotation of the polishing head about the axis of rotation thereof.

14. Wafer polishing apparatus as set forth in claim 13 further comprising a spherical bearing assembly mounting the polishing head on the head drive mechanism for pivoting of the polishing head about a gimbal point lying no higher than the interface of the front surface of the wafer and the work surface of the polishing pad when the polishing head holds the wafer in engagement with the polishing pad, thereby allowing the plane of the retaining ring to continuously align itself to equalize pressure of the retaining ring on the polishing pad, while rotation of the polishing head is driven by the head drive mechanism.

15. Wafer polishing apparatus as set forth in claim 1 wherein said polishing head includes an annular hoop, wherein the sealing ring is clamped between the back plate and the annular hoop.

16. Wafer polishing apparatus as set forth in claim 1 wherein a portion of the back plate engageable with said second major surface of the sealing ring is non-smooth to reduce the contact area of the back plate engageable with the sealing ring to reduce the adhesive forces for allowing the back plate to release the sealing ring.

17. Wafer polishing apparatus as set forth in claim 1 further comprising a fluid pressure control adapted to affect fluid pressure within the cavity.

18. Wafer polishing apparatus as set forth in claim 17 wherein the pressure control is adapted to selectively apply positive pressure to the cavity for urging the wafer toward the polishing pad to polish the front surface of the wafer and to apply a vacuum pressure to the cavity for capturing the wafer on the polishing head.

19. Wafer polishing apparatus as set forth in claim 17 wherein the back plate has at least one orifice therein for fluid communication of the cavity with the pressure control.

20. Wafer polishing apparatus as set forth in claim 1 wherein said sealing ring comprises an elastomeric material selected from a group including rubber, silicone and urethane.

21. Wafer polishing apparatus as set forth in claim 1 wherein the back plate is a one-piece, rigid part.

22. Wafer polishing apparatus as set forth in claim 1 wherein the sealing ring has an inner diameter of the central opening as measured when not engaging the wafer which is between 160 mm and 180 mm.

23. A method of polishing a semiconductor wafer comprising the steps of:

placing a rear surface of the semiconductor wafer in engagement with an annular sealing ring of the polishing head of a wafer polishing apparatus to form a fluid pressure cavity defined by the rear surface of the wafer, the sealing ring and the polishing head, the sealing ring having a first surface and second surface opposite said first surface defining a thickness and disposed around a central region of the polishing head, the sealing ring having a central opening extending through the complete thickness of the sealing ring, the sealing ring being adapted to flex and conform to the rear surface of the wafer upon receiving the wafer on the polishing head such that a portion of the first surface conforms to a peripheral edge margin of the wafer and a portion of said second surface faces the back plate, wherein the central opening as measured when not engaging the wafer is less than 90% of the wafer diameter so that the first surface conforms to more than 10% of the wafer diameter at the outer peripheral edge margin of the wafer to frictionally engage the wafer;

engaging a front surface of the wafer on the polishing head with a polishing pad on a turntable;

obtaining relative motion between the wafer and the polishing pad;

urging the front surface of the wafer against the polishing pad by selectively applying air pressure within the cavity for pressing the wafer surface uniformly against the polishing pad, said air within the cavity directly engaging a majority of the rear surface of the wafer; and removing the wafer from the polishing head.

24. A polishing head for use with a wafer polishing apparatus for polishing a front surface of a wafer, the polishing head being adapted for holding the wafer in generally opposed relation with a polishing pad on a turntable and for rotation about an axis generally perpendicular to the front surface of the wafer, the polishing head including a back plate having at least a central region in opposed relation with a rear surface of the wafer when the wafer is received by the polishing head, and an annular sealing ring of flexible material having a first surface and second surface opposite said first surface defining a thickness and disposed around a central region of the back plate, the sealing ring having a central opening extending through the complete thickness of the sealing ring, the sealing ring being adapted to flex and conform to the surface of the wafer upon receiving the wafer on the polishing head such that a portion of the first surface conforms to a peripheral edge margin of the wafer and a portion of said second surface faces the back plate, wherein the central opening as measured when not engaging the wafer is less than 90% of the wafer diameter so that the first surface conforms to more than 10% of the wafer diameter at the outer peripheral edge margin of the wafer to frictionally engage the wafer, and wherein the rear surface of the wafer, the sealing ring and the back plate define a substantially fluid-tight cavity for controlling fluid pressure in the cavity.

25. A polishing head as set forth in claim 24 wherein the sealing ring has an inner diameter of the central opening as measured when not engaging the wafer which is greater than or equal to about 50% of the wafer diameter.

26. A polishing head as set forth in claim 25 wherein the sealing ring has an inner diameter of the central opening as measured when not engaging the wafer which is greater than or equal to about 80% of the wafer diameter.

27. A polishing head as set forth in claim 26 wherein the sealing ring has an inner diameter of the central opening as measured when not engaging the wafer which is preferably about 85% of the wafer diameter.

28. A polishing head as set forth in claim 24 wherein the polishing head further comprises a retaining ring mounted on the polishing head, the sealing ring being clamped between the retaining ring and the back plate.

29. A polishing head as set forth in claim 28 wherein the sealing ring extends outwardly from the retaining ring when the wafer is not received in the polishing head.

30. A polishing head as set forth in claim 29 wherein the sealing ring extends radially inwardly toward the axis of rotation of the polishing head when the wafer is not received in the polishing head to present said first major surface of the sealing ring for engagement with the rear surface of the wafer.

31. A polishing head as set forth in claim 28 further comprising a support pad mounted on the back plate, the support pad being made of a material less rigid than the back plate for resiliently engaging the wafer when mounting the wafer on the polishing head.

32. A polishing head as set forth in claim 31 wherein the support pad is non-smooth to reduce the contact area of the support pad engageable with the sealing ring to reduce the adhesive forces for allowing the support pad to release the sealing ring.

33. A polishing head as set forth in claim 24 comprising an annular hoop, wherein the sealing ring is clamped between the back plate and the annular hoop.

34. A polishing head as set forth in claim 24 further comprising a fluid pressure control adapted to affect fluid pressure within the cavity.

35. A polishing head as set forth in claim 34 wherein the pressure control is adapted to selectively apply positive pressure to the cavity for urging the wafer away from the rear surface and to apply a vacuum pressure to the cavity for capturing the wafer on the polishing head.

36. A polishing head as set forth in claim 34 wherein the back plate has at least one orifice therein for fluid communication of the cavity with the pressure control.

37. A polishing head as set forth in claim 24 wherein said sealing ring comprises an elastomeric material selected from a group including rubber, silicone and urethane.

38. A polishing head for use with a wafer polishing apparatus for polishing a front surface of a wafer, the polishing head being adapted for holding the wafer in generally opposed relation with a polishing pad on a turntable and for rotation about an axis generally perpendicular to the front surface of the wafer, the polishing head including a back plate having at least a central region in opposed relation with a rear surface of the wafer when the wafer is received by the polishing head, and an annular sealing ring of flexible material having a thickness and disposed around the central region of the back plate, the sealing ring having a central opening extending through the complete thickness of the sealing ring, the sealing ring being disposed for engaging a peripheral edge margin of the wafer such that the rear surface of the wafer, the sealing ring and the back plate define a substantially fluid-tight cavity for controlling fluid pressure in the cavity, wherein the flexible material of the sealing ring is thin, having first and second opposite major surfaces, the sealing ring being adapted to flex upon receiving the wafer on the polishing head so that at least a portion of the first major surface of the sealing ring is engageable with the wafer for sealing with the wafer, wherein a portion of the back plate engageable with the second major surface of the sealing ring is at least one of cross-hatched or textured to reduce the contact area of the back plate engageable with the sealing ring to reduce the adhesive forces for allowing the back plate to release the sealing ring.

39. A method of processing a semiconductor wafer comprising the steps of:

forming an oxide layer on a rear surface of the semiconductor wafer;

free-mounting the semiconductor wafer on a polishing head of a wafer polishing apparatus by placing the rear surface of the semiconductor wafer in engagement with an annular sealing ring of the polishing head to form a fluid pressure cavity defined by the rear surface of the wafer, the sealing ring and the polishing head, the sealing ring having a first surface and second surface opposite said first surface defining a thickness and disposed around a central region of the polishing head, the sealing ring having a central opening extending through the complete thickness of the sealing ring, the sealing ring being adapted to flex and conform to the rear surface of the wafer upon receiving the wafer on the polishing head such that a portion of the first surface conforms to a peripheral edge margin of the wafer and a portion of said second surface faces the back plate, wherein the central opening as measured when not engaging the wafer is less than 90% of the wafer diameter so that the first surface conforms to more than 10% of the wafer diameter at the outer peripheral edge margin of the wafer to frictionally engage the wafer;

engaging a front surface of the wafer on the polishing head with a polishing pad on a turntable;

obtaining relative motion between the wafer and the polishing pad;

urging the front surface of the wafer against the work surface; and removing the wafer from the polishing head.

40. A method as set forth in claim 39 wherein the urging step further comprises selectively applying air pressure within the cavity for pressing the wafer surface uniformly against the polishing pad, said air within the cavity directly engaging a majority of the rear surface of the wafer.

41. A method as set forth in claim 40 wherein the forming step further comprises placing the semiconductor wafer in a bath.

42. A method as set forth in claim 41 wherein the forming step comprises at least a four minute soak in an aqueous solution of approximately 0.5 molar hydrogen peroxide and 0.03 molar ammonia.

43. A method as set forth in claim 41 wherein the forming step comprises a bath of an aqueous solution of oxide.

44. A wafer polishing apparatus for polishing a front surface of a wafer, the polishing apparatus comprising:

a base for supporting elements of the polishing apparatus;

a turntable mounted on the base for rotation about an axis on the base and adapted to support a polishing pad for conjoint rotation with the turntable, the polishing pad having a work surface engageable with the front surface of the wafer for use in polishing the front surface of the wafer;

a turntable drive mechanism operatively connected to the turntable for selectively driving rotation of the turntable about the axis of rotation; and a polishing head mounted for holding the wafer in generally opposed relation with the turntable and for rotation about an axis generally parallel to the axis of rotation of the turntable, the polishing head including a back plate having at least a central region in opposed relation with a rear surface of the wafer when the wafer is received by the polishing head and an annular sealing ring configured to engage and frictionally hold the wafer during polishing and provide a substantially fluid-tight cavity defined by the rear surface of the wafer, the sealing ring and the back plate, wherein the annular sealing ring has first and second opposite major surfaces and is shaped and arranged for engagement with the rear surface of the wafer so as to flex and bring a portion of the first major surface from a non-parallel position to an engaging position parallel with the wafer over a peripheral edge margin of the rear surface, said portion of the first major surface engaging the rear surface extending substantially to a peripheral edge of the rear surface of the wafer.

* * * * *